US007500869B2

(12) United States Patent
Wang

(10) Patent No.: US 7,500,869 B2
(45) Date of Patent: Mar. 10, 2009

(54) ELECTRICAL CONNECTOR WITH A SLIDING UPPER COVER

(75) Inventor: Lin Wang, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 11/941,607

(22) Filed: Nov. 16, 2007

(65) Prior Publication Data

US 2008/0286999 A1 Nov. 20, 2008

(30) Foreign Application Priority Data

May 15, 2007 (TW) ..... 96117186 A

(51) Int. Cl.
*H01R 12/24* (2006.01)

(52) U.S. Cl. ..... 439/495; 439/331

(58) Field of Classification Search ..... 439/495, 439/260, 259, 630, 331, 8
See application file for complete search history.

(56) References Cited

U.S. PATENT DOCUMENTS

| | | | | |
|---|---|---|---|---|
| 5,194,017 | A | 3/1993 | Consoli | |
| 5,498,169 | A | 3/1996 | Ikemoto | |
| 6,345,998 | B1 * | 2/2002 | Lee | 439/260 |
| 6,368,129 | B1 * | 4/2002 | Wang et al. | 439/260 |
| 6,482,027 | B2 * | 11/2002 | Ishii et al. | 439/495 |
| 6,561,843 | B1 * | 5/2003 | Ma et al. | 439/495 |
| 6,875,047 | B2 * | 4/2005 | Ueda | 439/495 |
| 6,893,267 | B1 * | 5/2005 | Yueh | 439/8 |
| 6,969,274 | B2 * | 11/2005 | Kudo et al. | 439/495 |
| 7,112,089 | B1 * | 9/2006 | Liu et al. | 439/495 |
| 2002/0013086 | A1 * | 1/2002 | Inoue | 439/495 |
| 2003/0236025 | A1 * | 12/2003 | Wu | 439/495 |
| 2004/0067679 | A1 * | 4/2004 | Maejima | 439/495 |
| 2007/0032114 | A1 * | 2/2007 | Sanders et al. | 439/260 |
| 2007/0054544 | A1 * | 3/2007 | Hirata | 439/495 |

FOREIGN PATENT DOCUMENTS

| | | |
|---|---|---|
| CN | 2852445 | 12/2006 |
| JP | 8124636 | 5/1996 |

OTHER PUBLICATIONS

English language translation of abstract of JP 8124636.
English language translation of abstract and pertinent parts of CN 2852445.

* cited by examiner

*Primary Examiner*—Neil Abrams
*Assistant Examiner*—Harshad C Patel
(74) *Attorney, Agent, or Firm*—Thomas, Kayden, Horstemeyer & Risley

(57) ABSTRACT

A connector includes a base, at least one first terminal, an upper cover, and a sliding structure. The base includes two opposite sides for defining the receiving space. The first terminal includes a contact end and a fixed end, wherein the contact end is disposed in the receiving space and the fixed end extends outside the receiving space. The upper cover includes two opposite edges. The sliding structure is disposed on the two opposite sides of the base that correspond to the two opposite edges of the upper cover. In this sliding structure, the two opposite edges are able to slide along the two opposite sides.

14 Claims, 5 Drawing Sheets

ELECTRICAL CONNECTOR WITH A SLIDING UPPER COVER

This application claims priority to Taiwan Patent Application No. 096117187 filed on May 15, 2007; the disclosure of which is incorporated herein by reference in its entirety.

CROSS-REFERENCES TO RELATED APPLICATIONS

Not applicable.

BACKGROUND OF THE INVENTION

1. Field of the Invention

The present invention relates to a connector, and more specifically, to a connector with a sliding upper cover.

2. Descriptions of the Related Art

Many signal cables are used in electrical appliances to connect the printed circuit boards (PCBs) for signal transmission. One of the more popular signal cables is a soft and flat pipeline with a plurality of pins at both ends. Correspondingly, one or more connectors can be configured onto the PCB for connecting to the signal cables. A plurality of pins is also arranged at the end of each connector and corresponds to the pins at the terminal of each signal cable. After the signal cable is plugged into the connector, the signals can be transmitted therebetween.

FIGS. 1A and 1B schematically illustrate a conventional connector 100, comprising a cover 110 which can be opened pivotally as a piano lid. The cover 110 of the connector 100 is normally closed. When the signal cable 120 needs to be electrically connected to the inner terminal hidden under the cover 110, the cover can be pivotally turned to reveal the inner terminal. After the signal cable 120 is connected to the connector 100, the cover 110 is returned to the closed position so as to protect the connector and the signal cable underneath. A disadvantage of this conventional connector is that it requires a multitude of steps to establish a connection with the signal cable. Moreover, opening the cover requires more space and is unfavorable in today's technological trend of decreasing sizes. Furthermore, with either frequent closing and opening or improper usage, the cover 110 or the pivoting mechanism 130 can be easily damaged. When the cover of the connector is damaged, it is difficult to repair or replace the cover only because the entire connector needs to be replaced, thereby increasing the cost of the product.

Thus, it is advantageous to redesign the structure of the connector not only to increase the connection stability to the signal cables, but also to plug in the signal cables more conveniently. In addition, an option to repair or replace only the cover without having to replace the entire connector is desired. Lastly, the steps in establishing a connection with the signal cable should be simplified.

SUMMARY OF THE INVENTION

One objective of this invention is to provide a connector to which a signal cable can be connected easily and repeatedly with simplified steps. When the cover of the connector is damaged, it can be repaired or replaced easily. According to the above-mentioned objective, the connector comprises a base, a first terminal, an upper cover, and a sliding structure. The base includes two opposite sides for defining the receiving space. The first terminal includes a contact end and a fixed end wherein the contact end is adapted to be disposed in the receiving space. The fixed end extends outside the receiving space. The upper cover includes two opposite edges. The sliding structure is disposed on the two opposite sides of the base corresponding to the two opposite edges so that the two opposite edges are adapted to slide along the two opposite sides by the sliding structure.

The detailed technology and preferred embodiments implemented for the present invention are described in the following paragraphs with reference to the accompanying drawings.

DESCRIPTION OF THE PREFERRED EMBODIMENT

Figure 1A:
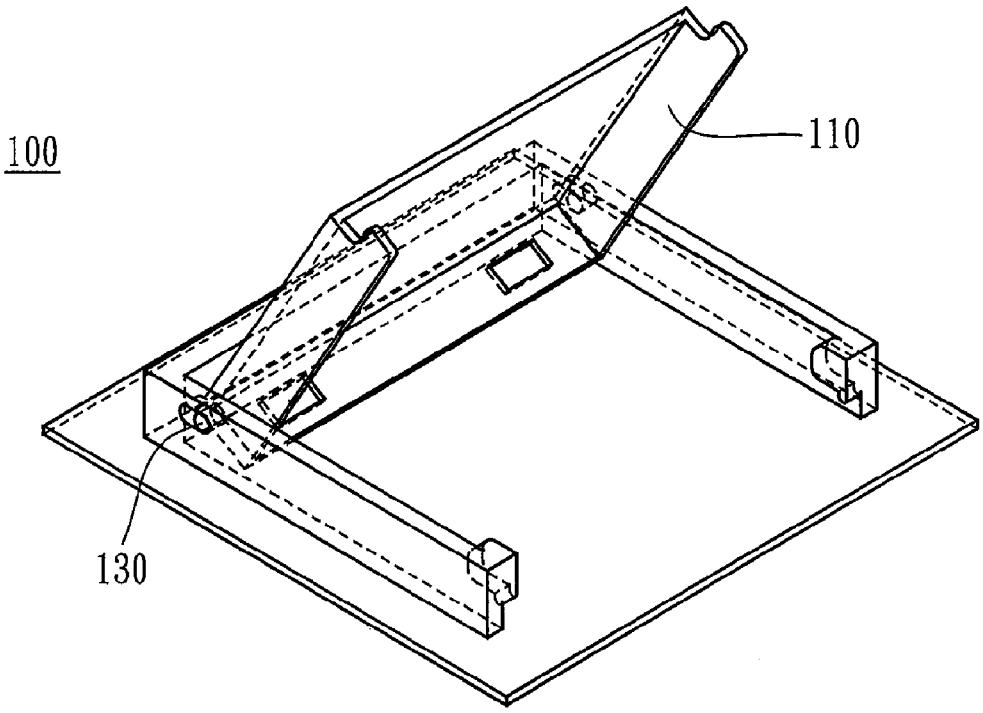
FIG. 1A (Prior Art)
FIG. 1A and FIG. 1B schematically illustrate a conventional connector.
Figure 1B:
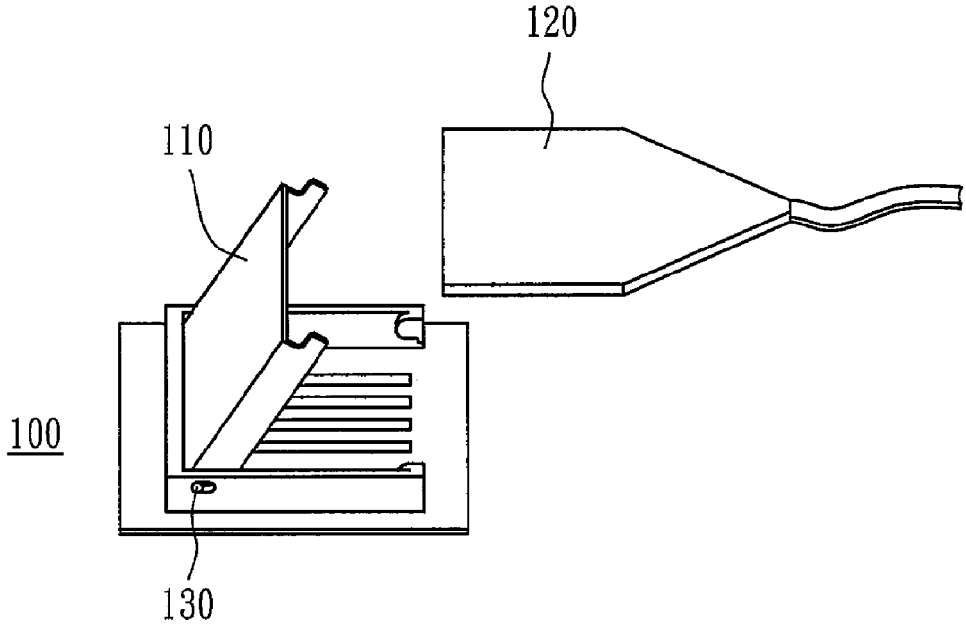
FIG. 1B (Prior Art)
Figure 2A:
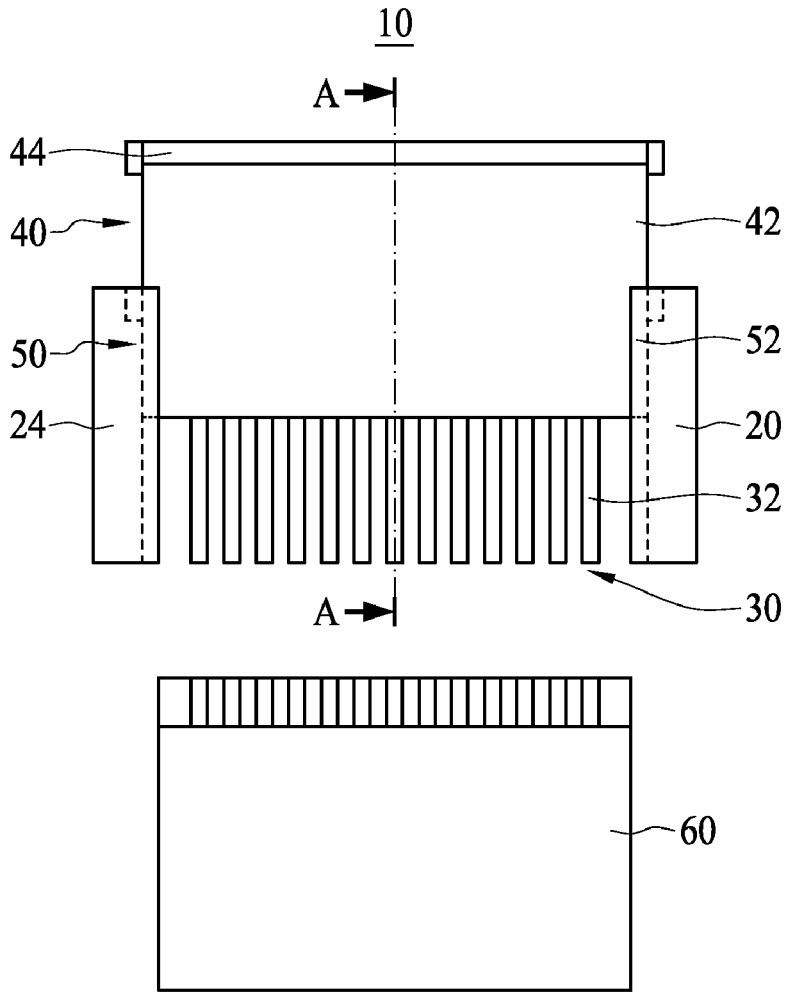
FIG. 2A schematically illustrates a top view of the connector according to an embodiment of the present invention.
Figure 2B:
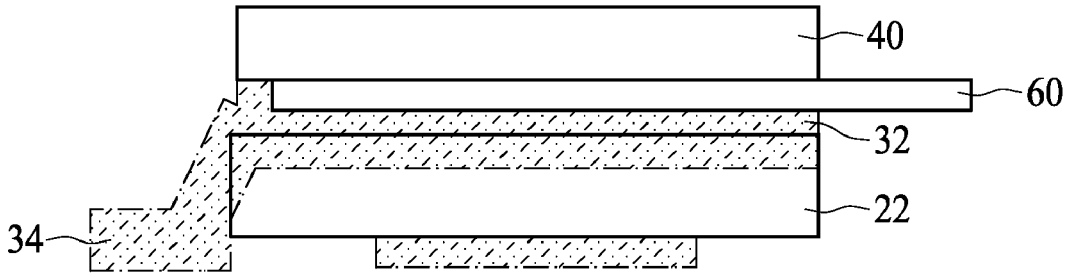
FIG. 2B schematically illustrates a cross-sectional view of the connector, taken along line A-A' in FIG. 2A, according to the present invention.

FIG. 2A schematically illustrates a top view of the connector according to an embodiment of the present invention while FIG. 2B schematically illustrates a cross-sectional view of the connector, taken along line A-A' in FIG. 2A, according to the present invention. The connector of the present invention can be wildly used in many existing PCBs. It is noted that the size and the shape of the connector shown in the figures of the present invention is used for explanations rather than limiting the scope of the invention.

According to the embodiment of the present invention, the connector 10 comprises a base 20, at least one first terminal 30, an upper cover 40 and a sliding structure 50. The connector 10 electrically connects to a signal cable 60 wherein the signal cable 60 can be, for example, a flexible printed circuit (FPC), or the like. Specifically, the base 20 comprises a body 22 and two opposite sides 24 configured individually to the two opposite ends of the body 22. The body 22 provides a flat plate for the connection between the connector 10 and the signal cable 60. More specifically, each of the two opposite sides 24 has a raised portion slightly higher than the horizontal surface of the body 22 so that a receiving space can be defined by the body 22. The two opposite sides 24 can hold the signal cable 60 when it connects to the connector 10.

Next, according to the embodiment of the present invention, the first terminal 30 of the connector 10 is disposed on the body 22 of the base 20. The first terminal 30 includes a contact end 32 and a fixed end 34, wherein the contact end 32 is disposed in the receiving space, which is defined by the body 22 and the two opposite sides 24. Moreover, the fixed end 34 extends outside the receiving space for welding the connector 10 onto the PCB.

According to the embodiment of the present invention, the connector 10 comprises an upper cover 40 which can slide back and forth. The upper cover 40 comprises two opposite edges 42, which can be embedded in the base 20 and can be moved therein. Specifically, a sliding structure 50 is disposed on the two opposite sides 24 of the base 20 corresponding to the two opposite edges 42 of the upper cover 40 so that the two opposite edges 42 of the upper cover 40 are adapted to slide along the two opposite sides 24 by the sliding structure 50.

More specifically, the sliding structure 50 comprises two slots 52, formed individually on the inner sides of the two opposite sides 24, so that the two opposite edges 42 can slide in the slots 52. In the preferred embodiment, the upper cover of the present invention is made of plastic materials or other flexible materials. Because the upper cover 40 is made of plastic, static sliding friction is generated between the two opposite edges 42 of the upper cover 40 and each of the slots 52 of the sliding structure 50 due to the close contact. As a result, the upper cover 40 is prevented from sliding out of the base 20. However, when an external drag force is applied to the upper cover 40, the dynamic sliding friction between the upper cover 40 and the slots 52 is not large enough to prevent the upper cover 40 from being easily moved.

In the preferred embodiment, a holder portion 44 can be disposed at a proper position on the upper cover 40 to facilitate users to move the upper cover 40. For example, the holder portion 44 can be a raised structure to allow a user to hold the holder portion 44 and move the upper cover 40 in the sliding structure 50 so that the receiving space can be more easily opened or closed.

Figure 3A:
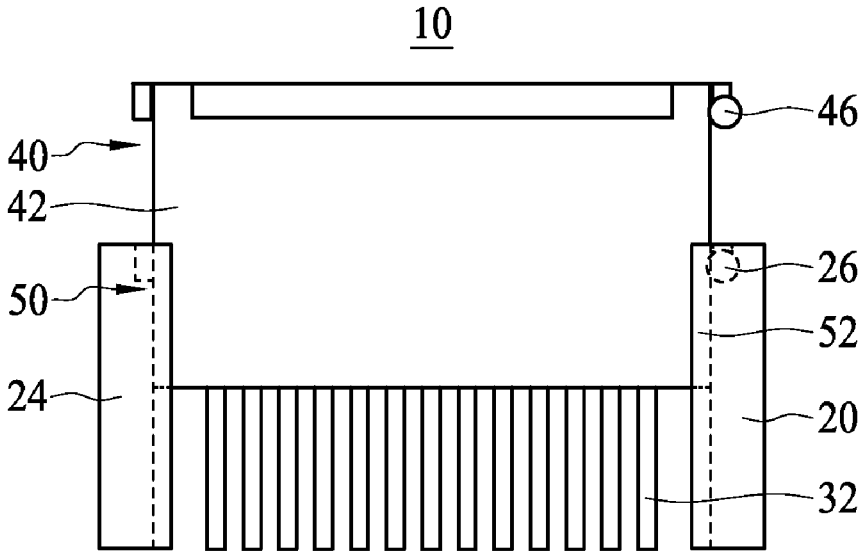
FIG. 3A and FIG. 3B schematically illustrate the connector according to another embodiment of the present invention.

Several embodiments regarding the upper cover 40 and the base 20 will be described as follows. FIG. 3 schematically illustrates the upper cover 40, which comprises the first fixing member 46, and the base 20, which comprises the second fixing member. The first fixing member 46 can match with the second fixing member 26 suitably when the upper cover 40 is located in a close position. Further, the upper cover is adapted to be fixed above the receiving space.

Figure 3B:
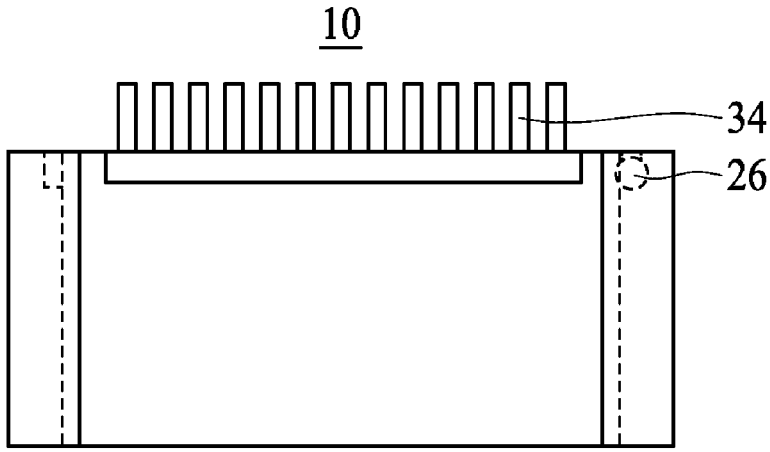

In an embodiment, the first fixing member 46 is the first protrusion, disposed on one of the two opposite edges 42 of the upper cover 40, while the second fixing member 26 is a recessed hole, disposed on one of the two opposite sides 24 of the base 20. The entrance width of the recessed hole is smaller than that of the first protrusion so that the first protrusion forms a close fit with the recessed hole. For example, the first fixing member 46 is configured on the rear area of one of the side edges 42 of the upper cover 40, while the second fixing member 26 is configured on the rear area of the corresponding side 24 of the base 20. When the upper cover 40 is in a close position corresponding to the base 20, only a little force is needed by the user to shift the upper cover 40 from the contact end 32 to the fixed end 34. The first fixing member 46 can be separated from the second fixing member 26 and open the receiving space to facilitate the user to plug the signal cable to the first terminal of the connector. On the contrary, after the signal cable 60 is electrically connected to the connector 10, the user can reversibly move the upper cover 40 from the fixed end 34 to the contact end 32. The first fixing member 46 is able to fit into the second fixing member 26 sufficiently tightly and close the receiving space accordingly, as shown in FIG. 3B. The corresponding relationship between the first fixing member 46 and the second fixing member 26 as described above is only for explaining rather than limiting the present invention. People skilled in the art can modify it easily after understanding the spirits of the present invention. For example, in another embodiment, several sets of the first fixing member 46 and the second fixing member 26 can be configured in the connector 10. In this case, two sets of the first fixing member 46 and the second fixing member 26 can be configured individually on both sides of the connector 10 so that a balanced fixing force can be exerted on the upper cover.

Figure 4A:
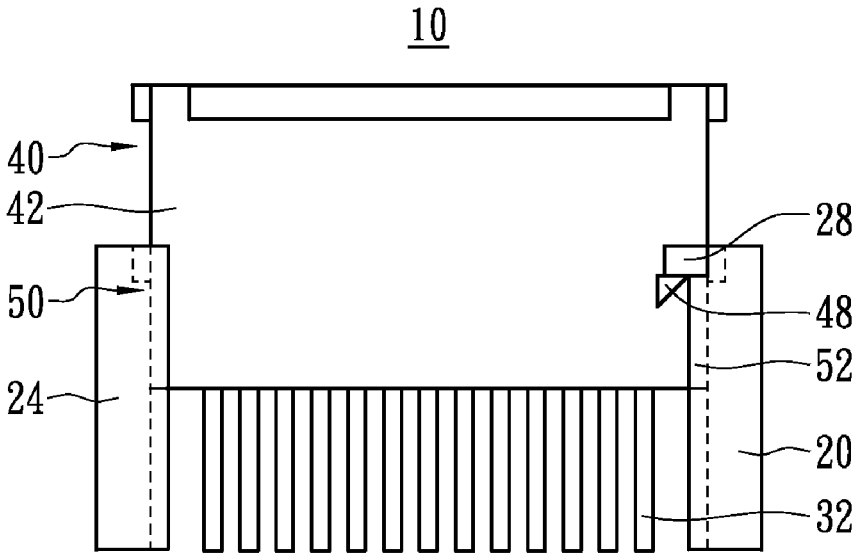
FIG. 4A and FIG. 4B schematically illustrate the connector according to still another embodiment of the present invention.

FIG. 4A schematically illustrates another configuration embodiment of the upper cover 40 and the base 20. In this embodiment, the upper cover 40 comprises a first blocking member 48, while the base 20 comprises a second blocking member 28. The first blocking member 48 can be disposed on the upper surface or the lower surface of the upper cover 40, while the second blocking member 28 must be disposed on the base 20 corresponding to the position of the first blocking member 48. Consequently, the first blocking member 48 matches the second blocking member 28 such that when the upper cover 40 is located in an open position, a resisting force can be generated therebetween to prevent the upper cover 40 from separating from the base 20.

Figure 4B:
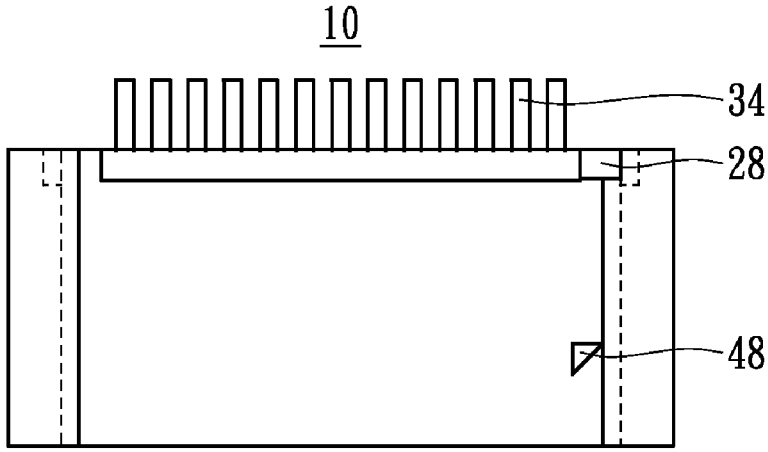

Moreover, the first blocking member 48 can be a second protrusion, disposed at a proper position in the front area of the upper cover 40. The second blocking member 28 can be a third protrusion, disposed at a proper position in the rear area of the two opposite sides 24 of the base 20 corresponding to the first blocking member 48. When the upper cover 40 is in a close position corresponding to the base 20, the upper cover 40 is static and has close contact with the base 20 by means of the static friction between the upper cover 40 and the slots 52, as shown in FIG. 4B. When the user holds the holder portion 44 and pulls the upper cover 40 from the contact end 32 to the fixed end 34, the first blocking member 48 collaborates with the second blocking member 28 to prevent the upper cover 40 from being separated from the base 20 after the receiving space is opened.

Figure 5A:
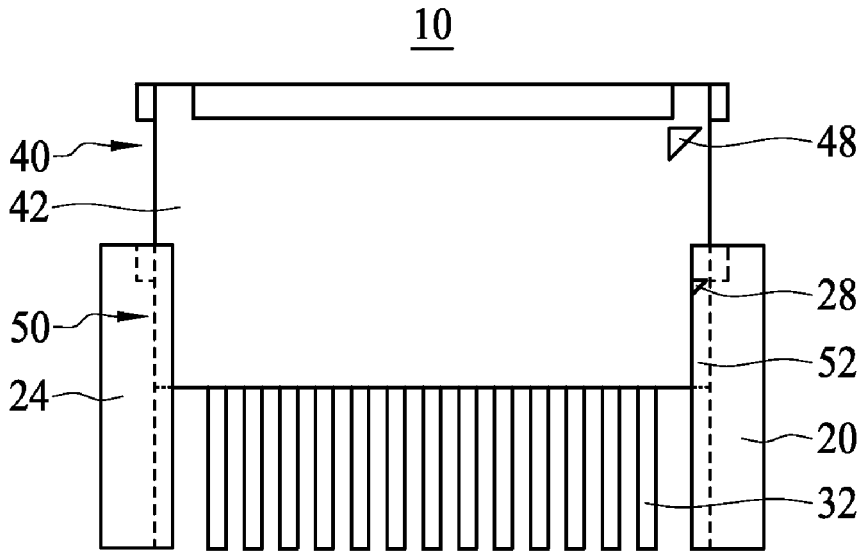
FIG. 5A and FIG. 5B schematically illustrate the connector according to yet still another embodiment of the present invention.
Figure 5B:
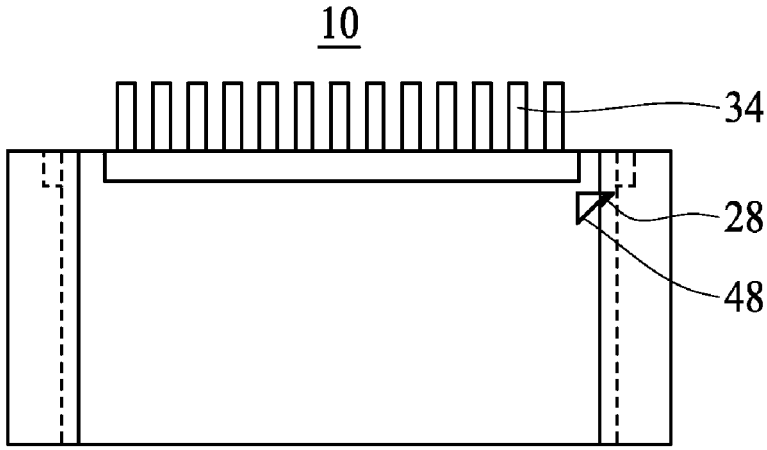

In addition, FIG. 5A schematically illustrates another configuration of the upper cover 40 and the base 20. The first blocking member 48 is disposed at a proper position in the rear area of the upper cover 40, while the second blocking member 28 is disposed on the side face of one of the two opposite sides 24 corresponding to the first blocking member 48. The functions of the first blocking member 48 and the second blocking member 28 are to hold the upper cover 40 in the base 20 so as to sufficiently close the receiving space when the upper cover 40 is disposed in an open position and is moving from the fixed end 34 to the contact end 32, as shown in FIG. 5B. As such, the first and the second blocking members can be protrusions in this embodiment.

It is noted that the aforementioned embodiments of the present invention are only described for explanations. They can be arbitrarily combined to meet actual requirements. Moreover, one of the features of the connector is that the upper cover can be separated from the base to achieve easy repair or replacement of a damaged upper cover. Specifically, in FIG. 3A and FIG. 5A, the user can easily exert a proper external force on the upper cover 40 to overcome the static friction between the upper cover 40 and the slots 52 so that the two edges 42 of the upper cover 40 can slide out of the base 20 along the direction from the contact end 32 to the fixed end 34 of the first terminal 30. Particularly, as shown in FIG. 4A, a resisting force can be generated between the first and the second blocking members 48 and 28 to prevent the upper cover 40 from being separated from the base 20. However, proper flexible materials can be used to form the first and the second blocking members 48 and 28 so that the user can exert a larger force on the upper cover 40 to release it from the base 20 while maintaining the shape of the first and second blocking members 48 and 28. As expected, repairs or replacements are still possible.

In summary, the user can connect the signal cable to the connector easily due to the ability of the connector's upper cover of the present invention to slide from the contact end to the fixed end of the first terminal to expose the receiving space. Moreover, the upper cover of the connector can be separated from the base for repairs or replacements to damaged components, thereby increasing the lifetime of the connector and reducing overall costs.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An electrical connector, comprising:

a base including two opposite sides for defining a receiving space;

a first terminal including a contact end and a fixed end, wherein the contact end is adapted to be disposed within the receiving space and the fixed end extends outside the receiving space;

an upper cover, adapted to side in an open position and a closed position in view of the receiving space, the upper cover including two opposite edges; and a sliding structure disposed in the two opposite sides of the base corresponding to the two opposite edges so that the two opposite edges are adapted to slide along the two opposite sides by the sliding structure from the open position that a signal cable is rested in the receiving space, to the closed position that the signal cable is capable of being firmly in contact with the contact end.

2. The connector of claim 1, wherein the sliding structure includes two slots, formed at the inner sides of the two opposite sides individually, so that the two opposite edges are received and slide in the slots.

3. The connector of claim 2, wherein each of the edges has close contact with each of the slots so that a sliding friction is generated between the upper cover and the slots.

4. The connector of claim 2, wherein the upper cover is made of plastic.

5. The connector of claim 1, wherein the upper cover includes a holder portion disposed on the upper cover.

6. The connector of claim 5, wherein the holder portion is a raised structure.

7. The connector of claim 1, wherein the upper cover comprises a first fixing member, and the base comprises a second fixing member, and wherein the first fixing member matches with the second fixing member when the upper cover is located in a close position so that the upper cover is adapted to be fixed above the receiving space.

8. The connector of claim 7, wherein the first fixing member is a first protrusion, disposed on one of the two opposite edges, the second fixing member is a recess hole, and the entrance width of the recess hole is smaller than that of the first protrusion so that the first protrusion forms close contact with the recess hole.

9. The connector of claim 7, wherein the first fixing member is disposed on a rear area of the upper cover and the second fixing member is disposed on a rear area of the base.

10. The connector of claim 1, wherein the upper cover comprises a first blocking member, and the base comprises a second blocking member, and wherein the first blocking member matches with the second blocking member when the upper cover is located in an open position so that a resisting force can be generated between the first and the second blocking members to prevent the upper cover from being separated from the base.

11. The connector of claim 10, wherein the first blocking member is a second protrusion, and the second blocking member is a third protrusion.

12. The connector of claim 10, wherein the first blocking member is disposed on a front area of the upper cover and the second blocking member is disposed on a rear area of the base.

13. The connector of claim 1, wherein the two opposite edges are adapted to slide from the contact end to the fixed end of the first terminal to expose the receiving space.

14. The connector of claim 13, wherein the two opposite edges are adapted to slide from the contact end to the fixed end of the first terminal till the upper cover separates from the base.

* * * * *